US005474314A

United States Patent [19]

Lehman

[11] Patent Number: 5,474,314

[45] Date of Patent: Dec. 12, 1995

[54] COASTER BOARD

[76] Inventor: James Lehman, 10106 Jockey Club Dr., Houston, Tex. 77065

[21] Appl. No.: 271,046

[22] Filed: Jul. 7, 1994

[51] Int. Cl.[6] ..... A63C 17/01

[52] U.S. Cl. ..... 280/87.042; 280/11.27; 280/112.2

[58] Field of Search ..... 280/11.19, 11.27, 280/11.28, 22.1, 87.041, 87.042, 100, 111, 112.2, 688

[56] References Cited

U.S. PATENT DOCUMENTS

| | | | |
|---|---|---|---|
| 3,436,088 | 4/1969 | Kunselman | 280/87.042 X |
| 3,992,025 | 11/1976 | Amelio | 280/87.042 |
| 4,133,546 | 1/1979 | Rosenblum | 280/87.042 X |
| 4,185,847 | 1/1980 | Johnson | 280/87.042 |
| 4,398,735 | 8/1983 | Evans et al. | 280/87.042 X |
| 5,263,725 | 11/1993 | Gesmer et al. | 280/87.042 X |
| 5,330,214 | 7/1994 | Brooks et al. | 280/87.042 X |

*Primary Examiner*—Mitchell J. Hill
*Assistant Examiner*—Michael Mar
*Attorney, Agent, or Firm*—Keeling Law Firm

[57] ABSTRACT

A coaster board operable on irregular terrain includes a longitudinally elongated platform supported on a pair of spaced suspension and steering systems. Each suspension and steering system includes a suspension rod and a cooperative steering bar. Each suspension rod is resiliently attached to the platform near the lateral center of the platform and is supported on independently rotatable wheels mounted laterally exterior of the platform. Each suspension rod includes a laterally central orifice. A steering bar is fixedly attached to the platform. A steering bar segment extends downwardly from the platform through the suspension rod orifice and engages interior lateral sides of the orifice whereby rotation of the coaster board platform and the steering bar in a vertical plane about an axis parallel to the longitudinal axis of the platform exerts downward force on a side of each suspension rod.

19 Claims, 2 Drawing Sheets

COASTER BOARD

FIELD OF THE INVENTION

The present invention relates generally to manually-propelled boards mounted on wheels and used for recreational purposes. In particular, the present invention comprises a coaster board, wheels and steering mechanism suitable for use on irregular terrain.

BACKGROUND OF THE INVENTION

Skateboards are commonly used for recreation purposes. Typical skateboards comprise an elongated board supported on four wheels. The board is arranged above the wheels. The skateboard rider balances on the board and adjusts the direction of travel by adjusting the pressure of his weight at various locations on the board.

As the board is located above the wheels, the wheel diameter is limited due to the necessity of the rider balancing on the board above the wheels and to allow the rider to adjust direction of travel by imparting pressure variations on the board. skateboard is therefore limited to relatively smooth terrain due to the need to accommodate relative small wheel size.

Skateboards are conventionally constructed with a pair of trucks attached to the underside of the elongated board. The trucks are aligned along the center line of the board. One truck is located near the front of the board with the other truck located near the end. Each truck supports a pair of skateboard wheels, the skateboard wheels extending laterally outward from each other and supported on axles. The trucks are typically screwed or otherwise fastened to the underside of the skateboard.

In a typical skateboard an axle support is mounted on the truck. An axle extends laterally outward from either side of the axle support. The skateboard wheels are each independently rotatable about the axle.

The axle is typically rotatable about a downward extending post, the post located adjacent the axle and towards the longitudinal center of the skateboard. A pivot pin extends from the axle member upwardly and outwardly from the center of the skateboard. The pivot pin engages a socket contained on the truck. Resilient bearings are provided at the engagement of the pivot pin with the socket. Resilient bearings are also provided at the engagement of the axle with the downward extending post. The resilient bearings allow limited rotation of the axle in both the horizontal and vertical plane.

The skateboard rider shifts weight on the skateboard to adjust the direction of travel of the skateboard. Shifting of weight by the rider towards a lateral side of the skateboard increases downward pressure on the wheels of such side. The axle is inclined slightly downward on the side to which weight is applied and lifted at the opposite side. This creates an increased drag on the forward rotation of the wheels, while at the same time decreasing pressure between the wheels and the ground on the opposite side of the skateboard. The foregoing effects turning of the skateboard in the direction of the side to which the weight is shifted.

An important aspect of a conventional skateboard is the ability of the rider to assert pressure on the wheel-to-ground contact interface to effectively control turning movements of the skateboard.

Conventional skateboards are normally limited in use to sidewalks, streets and other relatively smooth surfaces. It is a significant disadvantage of current skateboards that they cannot be operated on slightly irregular terrains such as grassy areas or dirt tracks. A skateboard-like apparatus utilizing larger wheels would be adaptable to more irregular terrain as a larger wheel diameter could overcome more obstacles. In particular, a skateboard-like apparatus utilizing larger wheels with relatively flexible tires, such as pneumatic wheels, would be adaptable to more irregular terrain as the inflated pneumatic wheels would enhance performance in a slightly irregular terrain.

Rosenblum U.S. Pat. No. 4,133,546 discloses a coasting vehicle adapted to be steered. The vehicle includes a pair of parallel platforms adapted to rotate or tilt about parallel axes, the platforms being coupled together. Wheels are mounted exterior of the platform fore and aft thereof. By having the wheels outboard of the coupled platforms they can be made larger so that the vehicle may be operated on other-than-paved surfaces. The Rosenblum patent discloses platform planes below the rolling axes of the wheels. Steering means are provided whereby the wheels may be steered by lateral movement of a track rod responsive to pivoting of the parallel platforms. The Rosenblum disclosure teaches the use of ski boots and ski bindings to practice the invention.

Johnson U.S. Pat. No. 4,185,847 discloses a skateboard having wheels mounted in independent suspension. Other patents describing skateboard or roller skateboard wheel mounting assemblies include Amelio U.S. Pat. No. 3,992,025, Kunselman U.S. Pat. No. 3,436,088, Mongeon U.S. Pat. No. 4,402,521 and Owsen, et. al. U.S. Pat. No. 2,676,812.

It is an object of the present invention to provide a coaster board operable on smooth or paved surfaces and readily operable on slightly irregular surfaces such as grassy areas, dirt tracks and other surfaces.

It is a further object of the present invention to provide a coaster board which may be steered by shifting of the body weight of the coaster board rider.

These and other objects of the present invention are accomplished with a coaster board operable on irregular terrain. The coaster board includes a longitudinally elongated platform supported on a pair of spaced suspension and steering systems. Each suspension and steering system includes a suspension rod and a cooperative steering bar. Each suspension rod is resiliently attached to the underside of the platform near the lateral center of the platform. Each suspension rod is supported on an axle and a pair of independently rotatable wheels mounted on the axle laterally exterior of the platform. Each suspension rod includes an orifice disposed laterally centrally of the suspension rod. A steering bar includes aligned distal ends attached to the bottom surface of the platform. Each steering bar end is laterally exterior of the location of the suspension rod connection to the platform. A central bar segment extends downwardly from the platform through the suspension rod orifice and engages the interior lateral sides of the orifice whereby rotation of the coaster board platform and the steering bar in a vertical plane about the longitudinal axis of the platform exerts downward pressure on a side of the suspension rod.

DETAILED DESCRIPTION OF THE INVENTION

Figure 1:
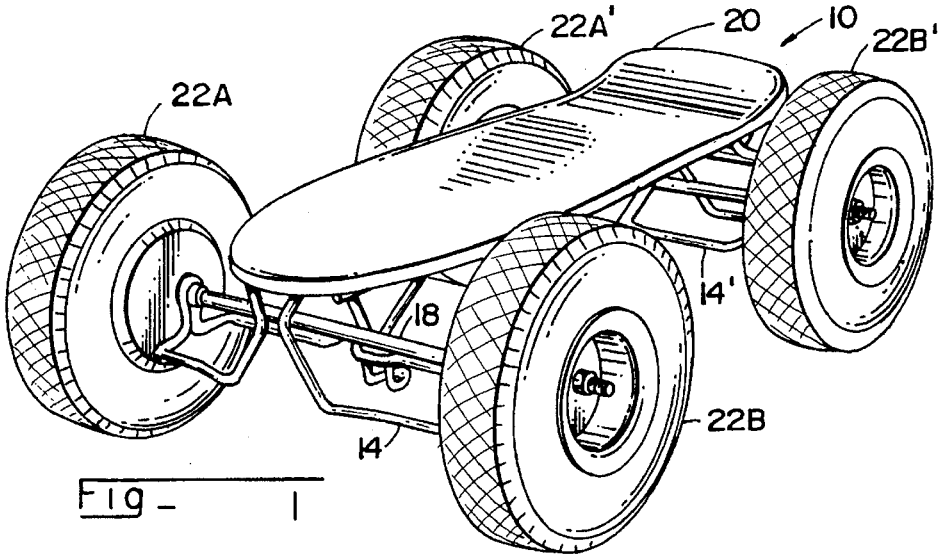
FIG. 1 depicts an isometric view of the coaster board of the present invention.
Figure 2:
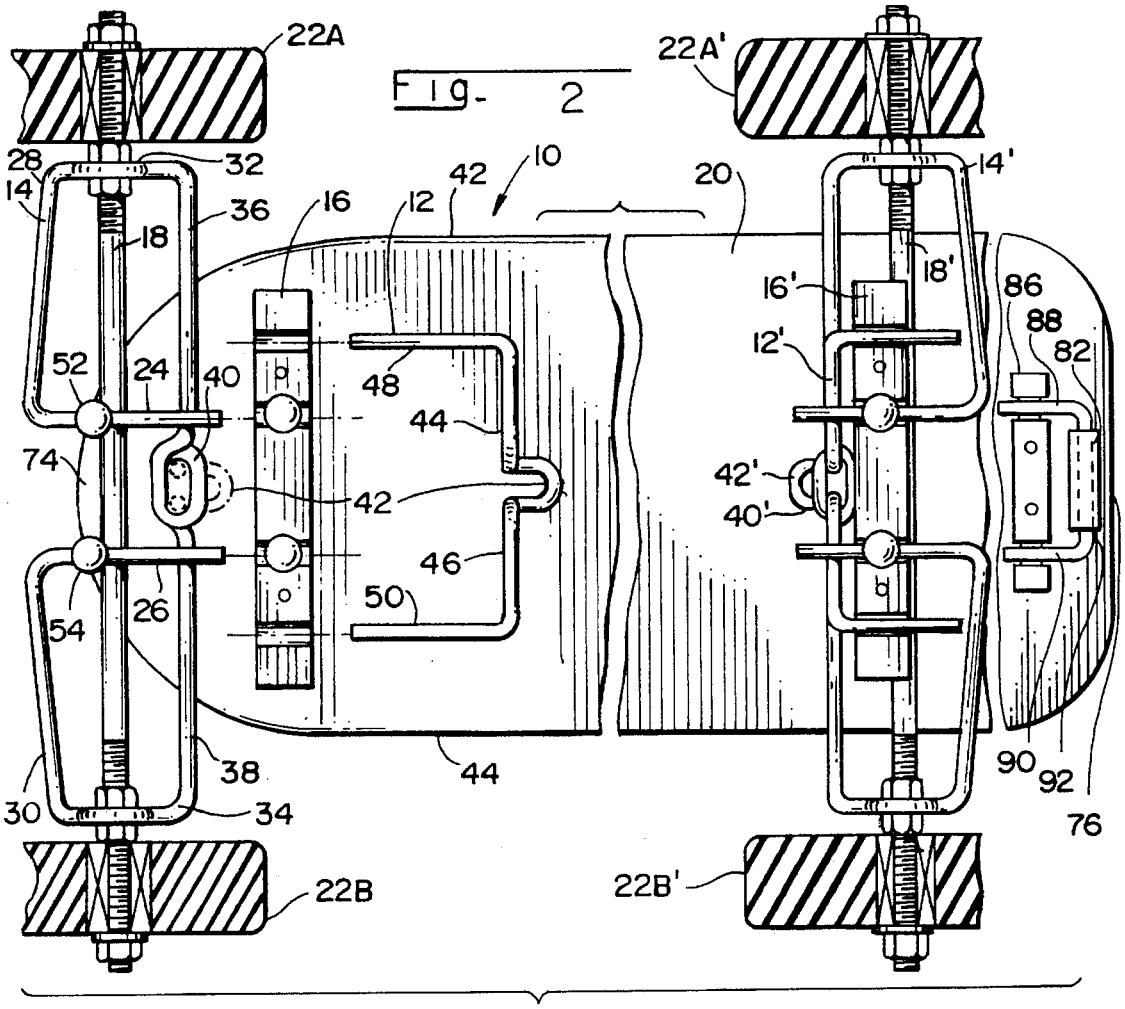
FIG. 2 depicts a partial plan view of the suspension and steering systems of the coaster board of the present invention as viewed through a transparent coaster board platform.

Referring to FIG. 1, the coaster board 10 of the present invention includes generally a platform 20, a front suspension rod 14, a rear suspension rod 14', a front axle 18, a rear axle 18', a front steering rod 18, a rear steering rod 18' (not shown in FIG. 1), front wheels 22A and 22B and rear wheels 22A' and 22B'. Referring to FIG. 2, the coaster board 10 further includes a front clamp block 16, a rear clamp block 16' and a stabilizer pad 82.

FIG. 2 is a plan view of the coaster board 10 as viewed through a transparent platform 20 with the front suspension rod 14 and the front steering bar 12 disassociated from the front clamp block 16. As depicted in FIG. 2, the front suspension rod 14, front axle 18, front steering rod 18 and front wheels 22A and 22B are located at the rounded front end 74 of platform 20. The rear suspension rod 14', rear steering rod 12', rear clamp block 16', and rear axle 18' are located near the rear end 76 of the platform with a stabilizer pad clamp 86 intermediate rear clamp block 16' and rear end 76.

Referring to FIGS. 1 and 2, front suspension rod 14 and front steering bar 12 are each operatively attached to platform 20 by clamp block 16. Front suspension rod 14 and front steering bar 12 each extend below the platform 20.

Front suspension rod 14 comprises an elongated rod having multiple bends defining various rod segments.

An orifice 40 is formed at the lateral center of the suspension rod 14 by providing a loop in suspension rod 14. Upon installation of the suspension rod 14 on the coaster board 10, orifice 40 is located below the platform 20 and laterally central of the platform 20. Orifice 40 is horizontally spaced from the axle 18 and vertically below the axle 18.

Inner segment 36 and inner segment 38 of suspension rod 14 each extend laterally outward from the central orifice 40. Each of inner segments 36 and 38 comprise generally horizontal extensions of suspension rod 14. Inner segment 36 extends laterally to the exterior of side 42 of platform 20. Inner segment 38 extends laterally to the exterior of side 44 of platform 20. Suspension rod 14 is symmetrical as to the longitudinal axis of platform 20 and inner segments 36 and 38 are the same length.

A front axle-engaging segment 32 extends forward at a right angle from inner segment 36 and a front axle-engaging segment 34 extends forward at a right angle from inner segment 38. Segment 32 is laterally oriented exterior of platform side 42 and interior of wheel 22A. Segment 34 is laterally oriented exterior of platform side 44 and interior of wheel 22B. The axle-engaging segment 32 and the axle-engaging segment 34 each extend generally parallel to platform sides 42 and 44 respectively.

Axle-engaging segment 32 includes a curvilinear segment 35. Axle-engaging segment 34 includes a curvilinear segment 37. The curvilinear segments 35 and 37 are each formed by curving the suspension rod 14 back on itself defining an opening within the segments 35 and 37. The opening defined by curvilinear segment 35 is depicted at 39 in FIG. 3 and the opening defined by curvilinear segment 37 is depicted at 41 in FIG. 3. Each of the openings 39 and 41 are sized and oriented to receive laterally-extending axle 18. Curvilinear segments 35 and 37 are parallel to each other and are longitudinally and vertically aligned.

The suspension rod 14 is further formed such that outer segment 28 extends laterally inwardly from axle-engaging segment 32 and outer segment 30 extends laterally inwardly from axle-engaging segment 34. Outer segments 28 and 30 extend initially horizontally from axle-engaging segments 32 and 34 respectively and then extend upwardly to the platform 20.

Figures 3, 4, 5, 6, 7:
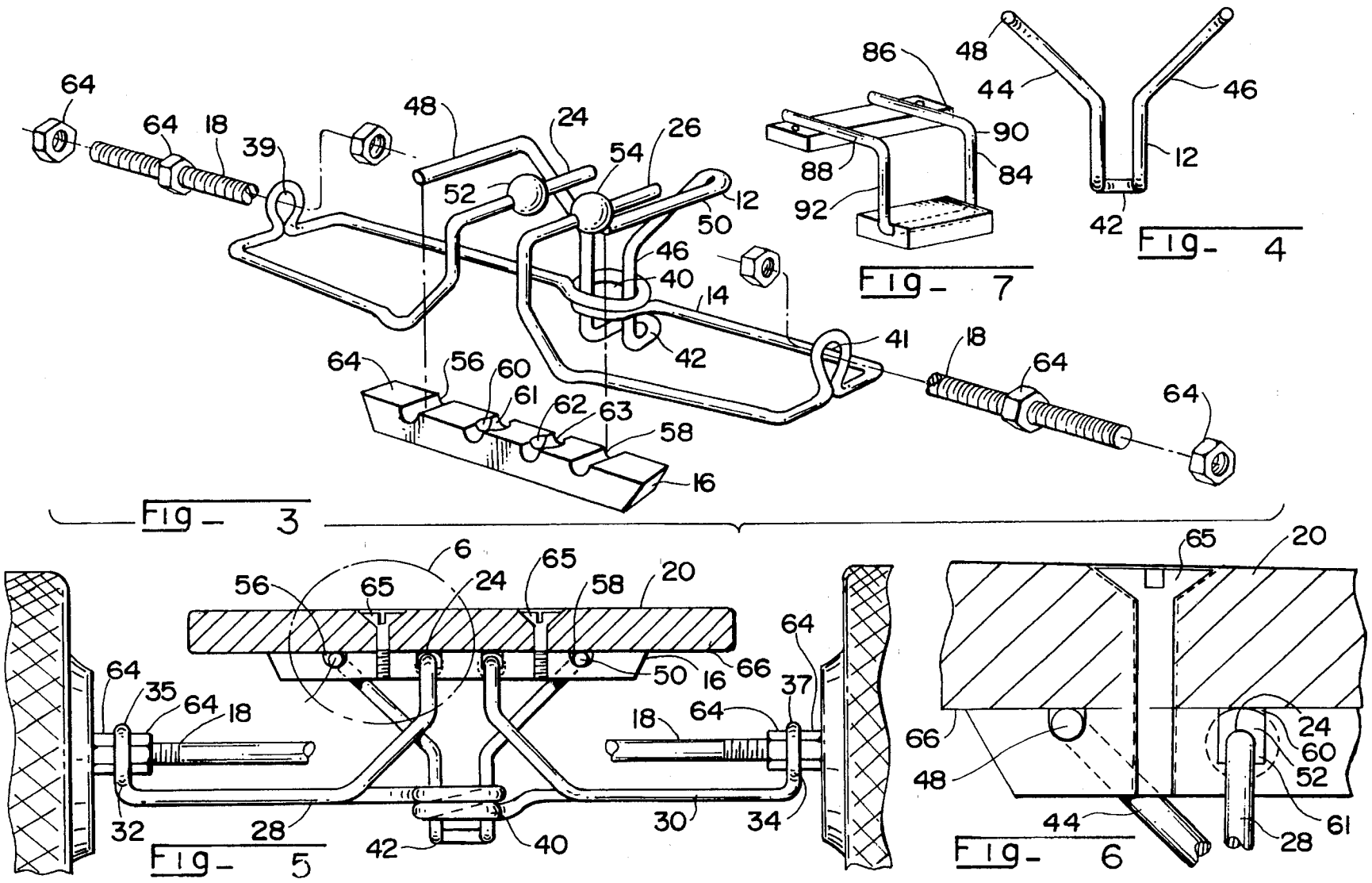
FIG. 3 depicts an isometric view of a suspension and steering mechanism of the coaster board of the present invention.
FIG. 4 depicts a steering bar of the coaster board of the present invention.
FIG. 5 depicts a frontal, partial cross-sectional view of the steering and suspension mechanism of the present invention.
FIG. 6 depicts a detail at 6 of FIG. 5.
FIG. 7 depicts an isometric view of a stabilizer block.

Referring to FIG. 6, together with FIGS. 1 and 2, end segment 24 extends from outer segment 28 below the bottom surface 66 of platform 20 toward the longitudinal center of platform 20. End segment 26 extends from outer segment 30 below the bottom surface 66 of platform 20 toward the longitudinal center of platform 20. End segments 24 and 26 are vertically aligned and horizontally parallel.

Still referring to FIG. 2, ball 52 comprises a spherical member supported on end segment 24 and ball 54 comprises a spherical member supported on end segment 26. Each of ball 52 and ball 54 are provided with central openings extending through the balls 52 and 54, which openings are sized such that the balls 52 and 54 closely fit onto the respective end segments 24 and 26. The balls 52 and 54 are longitudinally aligned on the end segments 24 and 26. The balls 52 and 54 are each constructed of a resilient material such as hard rubber or urethane.

The suspension rod 14 thereby comprises an elongated rod having a centrally located orifice 40 located horizontally centrally of the platform 20 and below the axle 18. Axle-engaging segments 32 and 34 are located laterally exterior of the platform 20. End segments 24 and 26 of suspension rod 14 extend below the bottom surface 66 of the platform 20 near the lateral center of platform 20. Axle 18 extends laterally through curvilinear segment 35 of axle-engaging segment 32 and through curvilinear segment 37 of axle-engaging segment 34.

Still referring to FIG. 1 and FIG. 2, steering bar 12 comprises an elongated rod having multiple bends defining various bar segments. Steering bar 12 is symmetrical about the longitudinal axis of the platform 20. The suspension bar 14 and the steering bar 12 may be formed from rods having the same size and physical characteristics, the term bar being utilized herein primarily to differentiate the components.

Steering bar 12 is provided with a central curvilinear bar segment 42. The central bar segment 42 is formed in the shape of a hemispherical arc. The central bar segment 42, upon installation of steering bar 12, is oriented toward the longitudinal center of the platform 20 and horizontally to the platform 20.

Bar side 44 extends laterally outwardly and upwardly from central bar segment 42 to the bottom surface 66 of platform 20. Bar side 46 extends laterally outwardly and upwardly from central bar segment 42 to the bottom surface 66 of platform 20 in the lateral direction opposite bar side 44.

Bar end segment 48 extends from bar side 44 along the bottom surface 66 of platform 20. Bar end segment 50 extends from bar side 46 along the bottom surface of platform 20. Bar end segments 48 and 50 are horizontally aligned and parallel. Upon installation, bar end segments 48 and 50 are retained against the bottom surface of platform 20 by clamp block 16.

Referring to FIG. 4, an end view of steering bar 12 is depicted. The central bar segment 42 extends generally horizontally. Bar side 44 and bar side 46 each extend upwardly and outwardly from central bar segment 42. Bar sides 42 and 44 define a generally Y-shaped form. Bar end segment 48 and bar end segment 50 are parallel and extend horizontally.

Referring to FIG. 3 in addition to FIG. 1 and FIG. 2, the arrangement of the steering bar 12 and suspension rod 14 is depicted. Rod end segments 24 and 26 are parallel and near the center of the platform 20. Bar end segments 48 and 50 are generally parallel to rod end segments 24 and 26. Bar end segments 48 and 50 are spaced laterally outwardly from the center of the platform 20 (not shown in FIG. 3) externally of suspension rod end segments 24 and 26. The steering bar 12 and the suspension rod 14 are so constructed that the steering bar central segment 42 extends through the rod orifice 40 with bar sides 44 and 46 each engaging the suspension bar 14 internally of rod orifice 40. The axle 18 extends laterally through axle-engaging segments 32 and 34.

Clamp block 16 is provided with two generally semi-circular bar openings 56 and 58 in its upper surface 64. Semi-circular bar openings 56 and 58 are so sized that, upon attachment of clamp block 16 to platform 20, bar end segments 48 and 50 are fixedly retained between clamp block 16 and platform 20.

Clamp member 16 is additionally provided with two vertically-extending cylindrical ball openings 60 and 62 in its upper surface 64. Ball opening 60 is so sized that, upon attachment of clamp block 16 to platform 20, ball 52 is retained within the opening 60. Ball opening 62 is so sized that, upon attachment of clamp block 16 to platform 20, ball 54 is retained within the opening 62. Two rod openings 61 and 63 are further provided in the upper surface 64 of clamp 16. Rod opening 61 is sized and oriented to receive rod end segment 24. Rod opening 63 is sized and oriented to receive rod end segment 26.

Upon attachment of clamp block 16 to platform 20 rod end 24 extends through rod opening 61 with ball 52 retained within cylindrical opening 60 and rod end 26 extends through rod opening 63 with ball 54 retained within cylindrical opening 62. The cylindrical openings 60 and 62 have diameters generally equivalent to the diameters of balls 52 and 54 such that balls 52 and 54 fit tightly within the cylindrical openings 60 and 62. The bottoms of cylindrical openings 60 and 62 are rounded. The cylindrical openings 60 and 62 have a total depth generally equivalent to the diameters of the balls 52 and 54 such that balls 52 and 54 fit tightly between the bottom surface 66 of the platform 20 and the rounded bottoms of the cylindrical openings 60 and 62.

Referring to FIG. 5, clamp block 16, upon installation, is fixedly attached to the bottom surface 66 of platform 20. Clamp block 16 is attached to platform 20 by a plurality of screws 65. Bar end segments 48 and 50 are fixedly retained within bar openings 56 and 58 respectively and are effectively clamped between the clamp block 16 and the lower surface 66 of platform 20. Rod end segment 24 extends through rod opening 61 and rod end segment 26 extends through rod opening 63. Ball 52 is retained within ball opening 61. Ball 54 is retained within ball opening 63. The lower surface 66 of platform 20 engages the tops of the balls 61 and 63.

The axle 18 is attached to the axle-engaging segments 32 and 34 of suspension rod 14 by a plurality of threaded nuts 64. The threaded nuts 64 retain the wheels 22A and 22B on the axle 18 from lateral movement.

Conventional bearings between the axle and the wheel provide for independent rotation of the wheels. The bearings are not depicted as they are commercially-available conventional bearings.

Referring to FIG. 6, the engagement of bar end segment 48 and rod end segment 24 between platform 20 and clamp block 16 is depicted. The bar end segment 48 is fixedly retained in the bar opening 56 between clamp block 16 and the bottom surface 66 of platform 20. The rod end segment 24 extends through rod opening 61 between the clamp block 16 and the bottom surface 66 of platform 20. Ball 52 is retained within cylindrical opening 60 and bottom surface 66. Bar end segment 50 is fixedly retained in bar opening 58 and ball 54 is retained within cylindrical opening 62 in like manner to the connection of end segment 48 and ball 52 depicted in FIG. 6.

Referring again to FIG. 2, a rear suspension rod 14', a rear steering bar 12', a rear clamp block 16', rear axle 18', rear resilient balls 52' and 54', and rear wheels 22A' and 22B' are depicted. The rear suspension rod 14', the rear steering bar 12', the rear clamp block 16', the rear axle 18', rear resilient balls 52' and 54', and the rear wheels 22A' and 22B' are constructed the same as, and are arranged in the same manner as, the front suspension rod 14, the front steering bar 12, the front clamp block 16, the front axle 18, resilient balls 52 and 54, and the front wheels 22A and 22B. As the details of construction of the front and rear suspension rod and steering bar elements are the same, the details are not repeated.

In the preferred embodiment of the invention, wheels 22A, 22A', 22B, and 22B' comprise inflatable pneumatic wheels. The details of construction of such wheels are omitted as such wheels are commercially available. A suitable wheel includes a wheel having a nominal diameter of ten inches (254 cm) such as wheels often installed on dollies, carts, go-carts, lawn mowers and like vehicles. Each of the wheels 22A and 22B are independently mounted on the front axle 18 by means of conventional, commercially-available bearing assemblies 23A and 23B. Each of the wheels 22A' and 22B' are mounted on the rear axle 18' by conventional commercially-available bearing assemblies 23A' and 23B'.

Still referring to FIG. 2 a stabilizer pad 82 is depicted. Stabilizer pad 82 is mounted on a stabilizer pad support 84. Stabilizer pad support 84 is mounted below the platform 20 by a stabilizer pad clamp 86. Stabilizer pad support 84 comprises a generally u-shaped rod having a central portion 92 extending downwardly and longitudinally outwardly from the rear of platform 20 and having aligned, parallel stabilizer pad support ends 88 and 90. Stabilizer pad support ends 88 and 90 are clamped to the bottom surface 66 of platform 20 near the rear end 76 of platform 20. The stabilizer pad 82 is fixedly attached to the central portion 92 of the stabilizer pad support 84. The stabilizer pad 82 is therefore supported below the platform 20 and longitudinally posterior of rear wheels 22A' and 22B'.

OPERATION

Referring to FIGS. 1, 2 and 5, the operator of the coaster board 10 of the present invention may propel the subject coaster board by standing on the platform 20 and pushing with a foot against the ground. On horizontal ground, when the operator's weight is balanced at the center of the platform 20, the platform 20 will be horizontal and the bar end segments 48 and 50 will be horizontal. In the event that the operator desires to steer the vehicle laterally, the operator may do so by shifting his feet on the platform towards a lateral side 42 or 44 of the platform. Upon such a shift, the operator's weight will depress the lateral side 42 or 44 of the platform 20 as the resilient balls 52, 54, 52' and 54' will allow movement of the platform 20 in relation to the suspension rods 14 and 14'. As the steering bars 12 and 12' are fixedly attached to platform 20, the steering bars 12 and 12' are likewise inclined thereby asserting downward pressure on the lateral sides of orifices 40 and 40' of suspension rods 14 and 14'. Such pressure is transmitted by suspension rods 14 and 14' to the wheels, 22A and 22A' or 22B and 22B' as applicable, thereby increasing the weight on the wheels on a lateral side of the platform 20. The resulting relatively larger vertical force on wheels on one side of the platform provides increased friction between the wheel and ground on such side in relation to the wheel-to-ground friction of the opposing side. As the wheels 22A, 22B, 22A' and 22B' are independently rotatable, such imbalance in friction produces differential wheel rotational velocities.

The resilient balls 52, 54, 52' and 54' allow limited rotational movement of the platform 20 in relation to the suspension rods 14 and 14' in the vertical plane.

The resilient balls 52, 54, 52' and 54' further allow limited rotational movement of the suspension rods 14 and 14' in relation to the longitudinal axis of platform 20. The frictional imbalance on the wheels results in limited rotation of the suspension rods 14 and 14' in relation to the longitudinal axis of platform 20. As the increased friction is on a side pair of wheels, 22A and 22A' or 22B and 22B', the rotation of the suspension rods 14 and 14' will be in the direction of the longitudinal center of the platform 20 on the side 42 or 44 of platform 20 to which the increased weight is applied.

The differential friction on a side pair of wheels, 22A and 22A' or 22B and 22B', and the limited rotation of the suspension rods 14 and 14' in the horizontal plane result in lateral change in direction of the coaster board 10.

In the event that the operator desires to stabilize the coaster board 10, the operator may shift weight placement toward the rear of platform 20 to cause the rear end 76 of the platform to tilt downwardly until the stabilizer pad 82 engages the ground surface. The coaster board 10 is then balanced on three points defined by rear wheels 22A' and 22B' and stabilizer pad 82. With sufficient rearward pressure, the coaster board 10 may be stopped with such pressure.

The present invention has been depicted and described in terms of a preferred embodiment. Numerous variations and details of construction and arrangement of members may be apparent to those skilled in the art, which variations are encompassed within the spirit of the invention and the scope of the appended claims.

I claim:

1. A coaster board, comprising:

an elongated, generally planar platform having a longitudinal axis;

said platform supported on a first suspension member by first suspension connection means;

said platform supported on a second suspension member by second suspension connection means;

said first suspension member and said second suspension member each supported on axle means and wheels;

a first steering member and a second steering member each fixedly attached to said platform;

first engagement means engaging said first steering member with said first suspension member and second engagement means engaging said second steering member with said second suspension member, said first engagement means including a first central orifice in said first suspension member, said first steering member engaging lateral sides of said orifice, and said second engagement means including a second central orifice formed in said second suspension member, said second steering member engaging lateral sides of said second orifice;

said first engagement means and said second engagement means aligned with the longitudinal axis of said platform and below said platform;

said platform, said first steering member, and said second steering member rotatable in a vertical plane about an axis parallel to the platform longitudinal axis;

rotation of said platform in a vertical plane about an axis parallel to the platform longitudinal axis imposing differential vertical loading on lateral sides of each of said first suspension member and said second suspension member through said first engagement means and said second engagement means.

2. A coaster board according to claim 1, wherein said first steering member including a first central segment extending through said first central orifice; and said second steering member including a second central segment extending through said second central orifice.

3. A coaster board according to claim 1, wherein said first suspension connection means including at least one first resilient member intermediate said first suspension member and said platform; and said second suspension connection means including at least one second resilient member intermediate said first suspension member and said platform.

4. A coaster board according to claim 3 wherein said at least one first resilient member comprising at least one first resilient ball member; and said at least one second resilient member comprising at least one second resilient ball member.

5. A coaster board according to claim 3 wherein said first suspension connection means including at least one first resilient ball connected to said first suspension rod and retained between a housing provided in a clamp block and said platform; and said second suspension connection means including at least one second resilient ball connected to said second suspension rod and retained between a housing provided in a clamp block and said platform.

6. A coaster board according to claim 1, wherein said wheels are located laterally exterior of said platform.

7. A coaster board according to claim 6, wherein said wheels including a pliable tire surface.

8. A coaster board according to claim 6, wherein said wheels including pneumatic tires;

said wheels extending vertically higher than said platform.

9. A coaster board according to claim 1, further comprising a stabilizer pad at said platform second end;

said stabilizer pad extending below said platform intermediate said platform second end and said second axle.

10. A coaster board according to claim 1, wherein said first suspension member comprising an elongated rod including a first pair of opposed axle-engaging openings; and said second suspension member comprising an elongated rod including a second pair of opposed axle-engaging openings.

11. A coaster board, comprising:

an elongated, generally planar platform having a platform longitudinal axis;

said platform supported on a first suspension rod located near a longitudinal first end of said platform and further supported on a second suspension rod located near a distal second end of said platform;

said first suspension rod having outer portions with lateral axle-engaging openings for receiving a first axle and said second suspension rod having outer portions with lateral axle-engaging openings for receiving a second axle;

said first axle supported on a first pair of wheels and said second axle supported on a second pair of wheels;

a first steering bar fixedly attached to said platform near the platform first end and a second steering bar fixedly attached to said platform near the platform second end;

first engagement means engaging said first steering bar with said first suspension rod and second engagement means engaging said second steering bar with said second suspension rod;

said first engagement means and said second engagement means located near a lateral center of said platform and below said platform;

said platform, said first steering bar, and said second steering bar rotatably moveable in a vertical plane about an axis parallel to said platform longitudinal axis;

whereby rotation of said platform in a vertical plane about an axis parallel to said platform longitudinal axis imposes differential vertical loading on lateral sides of each of said first suspension rod and said second suspension rod through said first engagement means and said second engagement means.

12. A coaster board according to claim 11, wherein said first engagement means including a first rod orifice formed in said first suspension rod, said first steering rod engaging lateral sides of said orifice; and said second engagement means including a second rod orifice formed in said second suspension rod, said second steering rod engaging lateral sides of said second orifice.

13. A coaster board according to claim 12, wherein said first steering rod including a first central segment extending through said first rod orifice; and said second steering rod including a second central segment extending through said second rod orifice.

14. A coaster board according to claim 12, wherein said wheels are located laterally exterior of said platform;

said wheels extend vertically higher than said platform; and said wheels include a pliable circumferentially-extending wheel surface.

15. A coaster board according to claim 14, wherein said wheels include pneumatic tires.

16. A coaster board according to claim 13, further comprising a stabilizer pad at said platform second end;

said stabilizer pad extending below said platform intermediate said platform second end and said.

17. A coaster board according to claim 13 wherein said front suspension rod including distal front rod ends in parallel alignment below said platform, a resilient front ball disposed on each front rod end, a front clamp block including two front ball openings retaining said resilient front balls against said platform; and said rear suspension rod including distal rear rod ends in parallel alignment below said platform, a resilient rear ball disposed on each rear rod end, a rear clamp block including two rear ball openings retaining said resilient rear balls against said platform.

18. A coaster board, comprising:

an elongated platform having a platform longitudinal axis supported on a front suspension rod and a rear suspension rod;

the front suspension rod having outer portions with lateral axle-engaging openings for receiving a front axle;

the rear suspension rod having outer portions with lateral axle-engaged openings for receiving a rear axle;

the front axle supported on two longitudinally aligned front wheels;

the rear axle supported on two longitudinally aligned rear wheels;

said front suspension rod including a laterally central front rod orifice;

said rear suspension rod including a laterally central rear rod orifice;

a front steering bar having a front central bar segment extending through said front rod orifice, a portion of said front central bar segment adjoining said front central rod orifice;

a rear steering bar having a central bar segment extending through said rear rod orifice, a portion of said rear central bar segment adjoining said rear central rod orifice;

said front steering bar and said rear steering bar fixedly attached to said platform;

said front suspension rod and said rear suspension rod each resiliently engaging said platform;

whereby vertical rotation of said platform, said front steering bar, and said rear steering bar about an axis parallel to said platform longitudinal axis induces differential vertical force on the wheels through engagement of the front steering bar with the front suspension rod and through engagement of the rear steering bar with the rear suspension rod.

19. A coaster board according to claim 18 wherein said front suspension rod including distal front rod ends in parallel alignment below said platform, a resilient front ball disposed on each front rod end, a front clamp block including two front ball openings retaining said resilient front balls against said platform; and said rear suspension rod including distal rear rod ends in parallel alignment below said platform, a resilient rear ball disposed on each rear rod end, a rear clamp block including two rear ball openings retaining said resilient rear balls against said platform.

* * * * *